United States Patent [19]

Guadagni

[11] 3,999,759

[45] Dec. 28, 1976

[54] GAME BOARD APPARATUS

[75] Inventor: Joseph Guadagni, Brooklyn, N.Y.

[73] Assignee: Lawrence Peska Associates, Inc., New York, N.Y. ; a part interest

[22] Filed: May 27, 1975

[21] Appl. No.: 580,552

[52] U.S. Cl. ..... 273/131 B; 273/131 R; 273/131 AB; 273/131 D

[51] Int. Cl.[2] ..... A63F 3/00

[58] Field of Search ..... 273/131

[56] References Cited

UNITED STATES PATENTS

| | | | |
|---|---|---|---|
| 3,819,184 | 6/1974 | McPhail | 273/131 AB |
| 3,870,311 | 3/1975 | Klupp | 273/131 AB |
| 3,895,804 | 7/1975 | Lee | 273/131 AD |

*Primary Examiner*—Delbert B. Lowe

[57] ABSTRACT

A board game apparatus for a modified game of checkers includes a board having a top planar surface thereon. A three quarter circle of seven equally spaced markings that are joined together by a rim is contained on the top surface. A center point of the three quarter circle is joined to the markings by a plurality of lines. Two sets of three discs each are contained on the markings, wherein the discs are capable of moving between adjacent markings and the center point.

1 Claim, 4 Drawing Figures

GAME BOARD APPARATUS

BACKGROUND OF THE INVENTION

A number of U.S. Pat. Nos.: 942,984; 1,030,330; 1,364,290; 1,870,168; and 3,495,701 have employed various board game apparatuses having movable playing pieces thereon, but these aforementioned patents are non-applicable to my present invention.

SUMMARY OF THE INVENTION

My present invention relates to a unique and novel board game apparatus for playing a modified game of checkers.

An object of my present invention is to provide a modified checker game universally appealing to all age groups which employs two sets of three checkers each, wherein the objective of the game is to block the opposing player from moving.

Briefly, my present invention comprises a board having a top planar surface thereon. A three quarter circle of seven equally spaced markings that are joined together by a rim is contained on the top surface. A center point of the three quarter circle is joined to the markings by a plurality of lines. Two sets of three discs each are contained on the markings, wherein the discs are capable of moving between adjacent markings and the center point.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
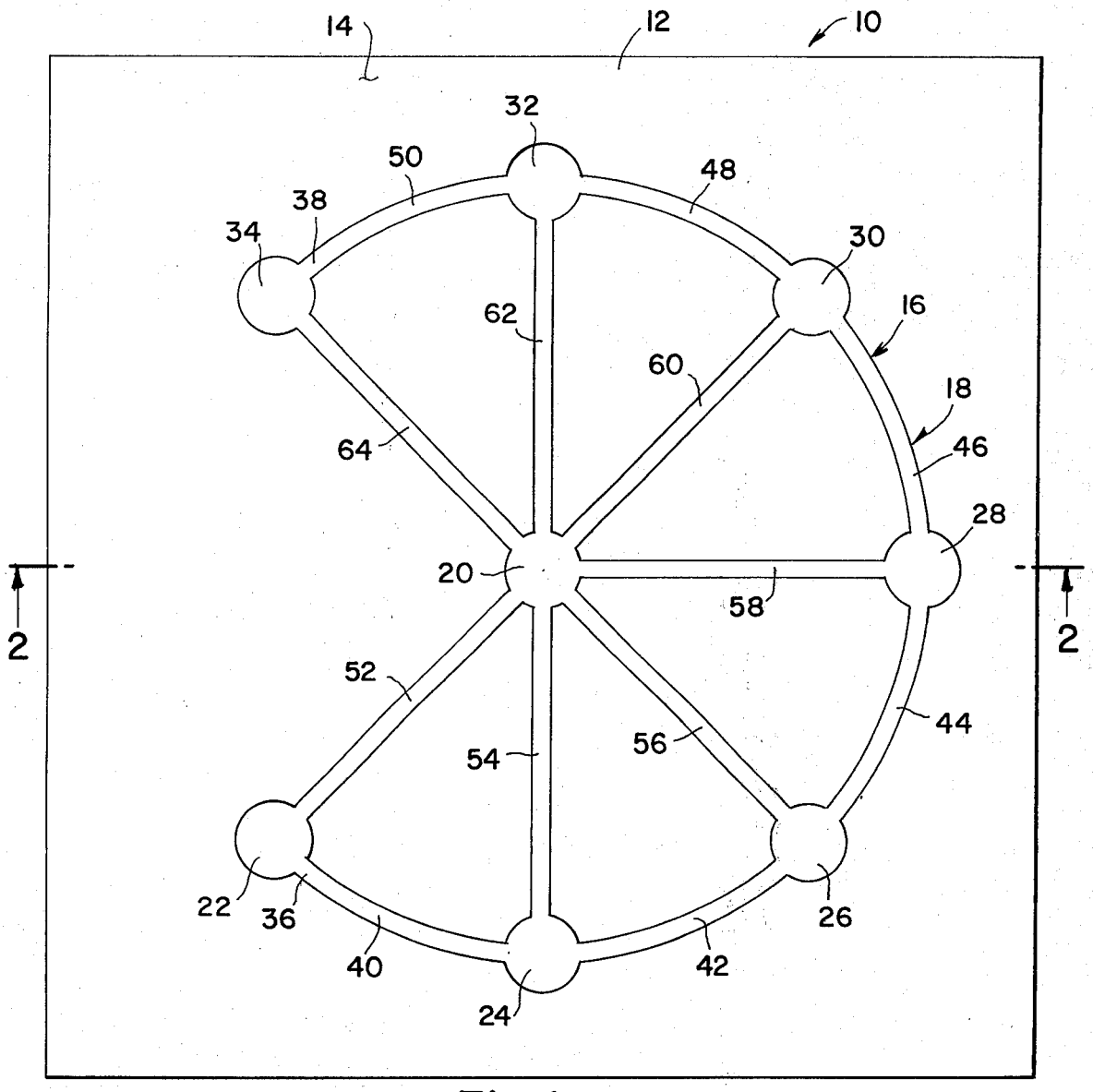
FIG. 1 illustrates a top planar view of a board game apparatus for a modified game of checkers.
Figure 2:
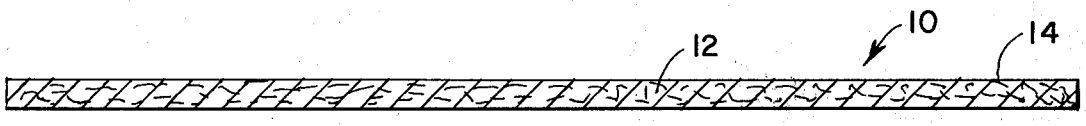
FIG. 2 illustrates an end view of the game board apparatus.

Turning now descriptively to the drawings, in which similar reference characters denote similar elements throughout the several views, FIGS. 1–2 show a game board apparatus 10 for playing a game of modified checkers. The game board apparatus 10 comprises a board 12 having a top planar surface 14 thereon. An arc 16 equal to three-quarters of a circle and having a center point marking 20 contained on the top surface 14 thereof. Seven circular markings 22, 24, 26, 28, 30, 32, 34 are contained on rim 18, wherein markings 22, 24, 26, 28, 30, 32, 34 are evenly spaced from one end 36 to the other end 38 of rim 18. The portions of the rim 18 interconnecting the markings 22, 24, 26, 28, 30, 32, 34 are labelled as follows:

1. Between markings 22, 24 – 40
2. Between markings 24, 26 – 42
3. Between markings 26, 28 – 44
4. Between markings 28, 30 – 46

5. Between markings 30, 32 – 48
6. Between markings 32, 34 – 50

A plurality of lines join the center point 20 to the markings 22, 24, 26, 28, 30, 32, 34 and they are marked as follows:

1. Between the center and marking 22 – 52
2. Between the center and marking 24 – 54
3. Between the center and marking 26 – 56
4. Between the center and marking 28 – 58
5. Between the center and marking 30 – 60
6. Between the center and marking 32 – 62
7. Between the center and marking 34 – 64

Figure 3:
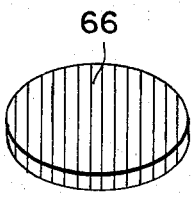
FIG. 3 illustrates a perspective view of a first playing disc.
Figure 4:
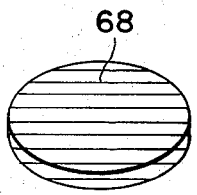
FIG. 4 illustrates a perspective view of a second playing disc.

Two sets of three check type discs 66, 68 are provided as shown in FIGS. 3, 4, wherein one set of discs is a first color and the other set is a second color.

The game is played as follows by two opposing players — Mr. Smith and Mr. Jones. Mr. Smith places his set of discs 66 on markings 22, 24, 26 and Mr. Jones places his set of discs 68 on markings 30, 32, 34. The play alternates back and forth between the players until an opposing player is blocked from moving. A player may move back and forth between any two adjoining markings joined together by a portion of the rim 18 or back and forth between any markings and the center point 20 as long as the marking or center point 20 is not blocked by any opposing disc. Some examples of winning combinations are as follows:

1. Discs 68 positioned on markings 22, 24, 34.
   Discs 66 positioned on markings 26, 32 and center point 20.
2. Discs 68 positioned on markings 30, 32, 34.
   Discs 66 positioned on markings 24, 28 and center point 20.
3. Discs 68 positioned on markings 28, 30, 32.
   Discs 66 positioned on markings 34, 26 and center point 20.
4. Discs 68 positioned on markings 28, 30, 34.
   Discs 66 positioned on markings 26, 32 and center point 20.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A board game apparatus adapted for playing a modified game of checkers, which comprises:

a. a board having a top planar surface thereon;
b. a three quarter circle of seven equally spaced markings on said top surface;
c. a center point marking of said three quarter circle on said top surface;
d. a plurality of lines joining said center point marking to each said marking;
e. a rim joining said markings together; and
f. two sets of three discs each movable between said seven markings and said center point marking, said two sets of said three discs being color coded differently.

* * * * *